US011867171B2

(12) United States Patent
Li et al.

(10) Patent No.: US 11,867,171 B2
(45) Date of Patent: Jan. 9, 2024

(54) FLUID SPLITTER IN A FLUID END OR PLUNGER PUMP

(71) Applicant: YANTAI JEREH PETROLEUM EQUIPMENT & TECHNOLOGIES CO., LTD., Shandong (CN)

(72) Inventors: Xiaobin Li, Shandong (CN); Jixin Wang, Shandong (CN); Baojie Wang, Shandong (CN); Haiping Cui, Shandong (CN); Peng Li, Shandong (CN); Shulin Zhang, Shandong (CN); Hailong Li, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 258 days.

(21) Appl. No.: 17/231,631

(22) Filed: Apr. 15, 2021

(65) Prior Publication Data

US 2022/0243724 A1 Aug. 4, 2022

(30) Foreign Application Priority Data

Feb. 4, 2021 (CN) ..... 202110156898.1
Feb. 4, 2021 (CN) ..... 202120342220.8

(51) Int. Cl.
*F04B 53/12* (2006.01)
*F04B 19/22* (2006.01)
(Continued)

(52) U.S. Cl.
CPC ..... *F04B 53/125* (2013.01); *F04B 19/22* (2013.01); *F04B 53/1087* (2013.01); *F04B 53/16* (2013.01)

(58) Field of Classification Search
CPC ..... F04B 1/0465; F04B 1/0461; F04B 1/053; F04B 53/125; F04B 19/22; F04B 53/1087; F04B 53/16; F04B 53/102
(Continued)

(56) References Cited

U.S. PATENT DOCUMENTS 3,309,013 A * 3/1967 Bauer ..... F04B 39/10 137/516.13
3,309,014 A * 3/1967 Bauer ..... F04B 39/1013 417/571
(Continued)

FOREIGN PATENT DOCUMENTS

CN 2267339 Y 11/1997
CN 105952633 A 9/2016
(Continued)

*Primary Examiner* — Kenneth J Hansen
*Assistant Examiner* — Benjamin Doyle
(74) *Attorney, Agent, or Firm* — XSENSUS LLP

(57) ABSTRACT

A fluid splitter, a fluid end, and a plunger pump are provided. The fluid splitter includes: a body having a shape of column and including a first end, a second end, and a side surface connecting the first end and the second end; a first opening, located at the side surface of the body; a first cavity, located at the first end; a first channel, communicated with the first opening and the first cavity, respectively, the first channel extending from the first opening to the first cavity and being configured to allow fluid to flow therethrough; a second opening, located at the side surface of the body; a second cavity, located at the second end; and a second channel, communicated with the second opening and the second cavity, respectively, the second channel extending from the second opening to the second cavity and being configured to allow fluid to flow therethrough.

19 Claims, 16 Drawing Sheets

(51) Int. Cl.
*F04B 53/10* (2006.01)
*F04B 53/16* (2006.01)

(58) Field of Classification Search
USPC ..... 417/568, 567, 545
See application file for complete search history.

(56) References Cited

U.S. PATENT DOCUMENTS 3,370,545 A * 2/1968 Waibel ..... F04B 39/1006 417/571
3,526,246 A * 9/1970 Anton ..... F04B 53/10 137/516.13
3,702,624 A * 11/1972 Fries ..... F04B 53/109 137/516.23
3,820,922 A * 6/1974 Buse ..... F04B 53/164 417/539
4,239,463 A * 12/1980 Yaindl ..... F04B 53/007 417/454
4,616,983 A * 10/1986 Hanafi ..... F04B 53/1032 417/571
4,878,815 A * 11/1989 Stachowiak ..... F04B 53/1025 417/454
4,924,901 A * 5/1990 Valavaara ..... F04B 53/109 137/627.5
5,037,276 A * 8/1991 Tremoulet, Jr. ..... F04B 53/103 417/470
5,037,277 A * 8/1991 Tan ..... F16K 17/0433 137/540
5,127,807 A * 7/1992 Eslinger ..... F04B 53/147 417/539
5,147,189 A * 9/1992 Barnowski ..... F04B 53/166 417/571
5,230,363 A * 7/1993 Winn, Jr ..... E21B 21/106 417/571
5,302,087 A * 4/1994 Pacht ..... F04B 53/007 417/571
5,605,449 A * 2/1997 Reed ..... F04B 53/109 417/454
5,636,975 A * 6/1997 Tiffany ..... F04B 53/109 417/454
7,296,591 B2 * 11/2007 Moe ..... F04B 53/109 137/512
9,371,919 B2 * 6/2016 Forrest ..... F16K 43/00
11,578,711 B2 * 2/2023 Thomas ..... F04B 7/0208
2015/0071803 A1 * 3/2015 Huang ..... F04B 39/1046 417/560
2016/0177943 A1 * 6/2016 Pacht ..... F04B 53/007 137/565.01
2017/0204850 A1 * 7/2017 Graham ..... F04B 47/02
2020/0370548 A1 11/2020 Chady et al.
2021/0148208 A1 * 5/2021 Thomas ..... F04B 53/1032
2022/0282725 A1 * 9/2022 Nowell ..... F16K 15/063

FOREIGN PATENT DOCUMENTS

CN 111219323 A 6/2020
CN 111502981 A 8/2020
CN 112814891 A 5/2021

* cited by examiner

Related Art

Related Art

FLUID SPLITTER IN A FLUID END OR PLUNGER PUMP

CROSS-REFERENCE TO RELATED APPLICATIONS

For all purpose, the application claims priority to the Chinese patent application No. 202110156898.1, filed on Feb. 4, 2021, the entire disclosure of which is incorporated herein by reference as part of the present application.

TECHNICAL FIELD

At least one embodiment of the present disclosure relates to a fluid splitter, a fluid end, and a plunger pump.

BACKGROUND

At present, fracturing operation is the main way to increase production in the process of oil and gas exploitation, and a plunger pump is the main equipment to pump fracturing medium in the stimulation operation. In other words, in the whole process of oil and gas exploitation, any process that needs to transfer medium into the well under a specific pressure needs to be realized by a plunger pump.

SUMMARY

At least one embodiment of the present disclosure relates to a fluid splitter, a fluid end, and a plunger pump.

At least one embodiment of the present disclosure provides a fluid splitter, including: a body, the body having a shape of column, and the body including a first end, a second end, and a side surface connecting the first end and the second end; a first opening, located at the side surface of the body; a first cavity, located at the first end; a first channel, communicated with the first opening and the first cavity, respectively, the first channel extending from the first opening to the first cavity and being configured to allow fluid to flow therethrough; a second opening, located at the side surface of the body; a second cavity, located at the second end; and a second channel, communicated with the second opening and the second cavity, respectively, the second channel extending from the second opening to the second cavity and being configured to allow fluid to flow therethrough.

For example, in some embodiments of the present disclosure, the first opening is closer to the second end than the second opening, and the second opening is closer to the first end than the first opening.

For example, in some embodiments of the present disclosure, the first opening and the second opening are located at different positions in an axial direction of the body.

For example, in some embodiments of the present disclosure, the first opening and the second opening face towards different directions and have a same size.

For example, in some embodiments of the present disclosure, the first channel is not communicated with the second channel, and the first cavity is not communicated with the second cavity.

For example, in some embodiments of the present disclosure, the body includes a first flow guide portion, a plurality of first channels are provided, the plurality of first channels are separated by the first flow guide portion, and the plurality of first channels are converged at the first cavity.

For example, in some embodiments of the present disclosure, a plurality of first openings are provided, the plurality of first channels are in one-to-one correspondence with the plurality of first openings, the plurality of first openings are distributed along a circumferential direction of the body, and the plurality of first openings are located at a same position in an axial direction of the body.

For example, in some embodiments of the present disclosure, the body includes a second flow guide portion, a plurality of second channels are provided, the plurality of second channels are separated by the second flow guide portion, and the plurality of second channels are converged at the second cavity.

For example, in some embodiments of the present disclosure, a plurality of second openings are provided, the plurality of second channels are in one-to-one correspondence with the plurality of second openings, the plurality of second openings are distributed along a circumferential direction of the body, and the plurality of second openings are located at a same position in an axial direction of the body.

For example, in some embodiments of the present disclosure, the first cavity includes a first step surface, and the first step surface divides the first cavity into two first sub-cavities having different areas in radial section; the second cavity includes a second step surface, and the second step surface divides the second cavity into two second sub-cavities having different areas in radial section.

At least one embodiment of the present disclosure further provides a fluid end, including: a valve casing including an inner chamber; and any one of the fluid splitters described above, the fluid splitter is located in the inner chamber.

For example, in some embodiments of the present disclosure, the inner chamber includes a pressure-alternating chamber, a low-pressure chamber, and a high-pressure chamber; the pressure-alternating chamber, the low-pressure chamber, and the high-pressure chamber are sequentially arranged in an axial direction of the valve casing, the second end is located in the high-pressure chamber, the first opening is located in the low-pressure chamber, the first end and the second opening are located in the pressure-alternating chamber, the second opening is communicated with the pressure-alternating chamber, the valve casing includes an inlet bore and an outlet bore, the inlet bore is communicated with the first opening, and the outlet bore is communicated with the high-pressure chamber.

For example, in some embodiments of the present disclosure, the fluid end further includes a plunger, the inner chamber further includes a plunger chamber, the plunger chamber is configured to receive the plunger, and the plunger chamber, the pressure-alternating chamber, the low-pressure chamber, and the high-pressure chamber are sequentially arranged in the axial direction of the valve casing.

For example, in some embodiments of the present disclosure, a part of the pressure-alternating chamber is arranged between the first end of the fluid splitter and the valve casing.

For example, in some embodiments of the present disclosure, the fluid end further includes a first valve assembly and a first guide portion, the first valve assembly is located in the pressure-alternating chamber, and the first valve assembly is configured to communicate the low-pressure chamber with the pressure-alternating chamber upon being opened, or configured to separate the low-pressure chamber from the pressure-alternating chamber upon being closed, the first valve assembly includes a first valve-body, a first seal, and a first valve seat; the first valve seat is annular and includes a first intermediate bore, the first intermediate bore is configured to allow fluid to flow therethrough, the first valve-body includes a first main portion, and a first guide rod and a second guide rod which are arranged at two sides of the first main portion, respectively; a part of the first seal is embedded in a first groove of the first main portion, the first valve seat and the first guide portion are located in the first cavity, and the first valve-body is not in contact with the valve casing.

For example, in some embodiments of the present disclosure, the fluid end further includes a first spring and a spring seat, the first spring is located between the spring seat and the first main portion, the first guide portion includes a first guide seat and a first guide sleeve connected with the first guide seat, the first guide seat includes a first through hole, the first through hole is configured to allow fluid to flow therethrough, the first guide sleeve is configured to receive a part of the first guide rod so as to guide the first valve-body, the spring seat has a second guide sleeve, and the second guide sleeve is configured to receive a part of the second guide rod so as to guide the first valve-body.

For example, in some embodiments of the present disclosure, the spring seat has an annular groove configured to place the first spring and a hollowed structure configured to allow fluid to flow therethrough.

For example, in some embodiments of the present disclosure, the fluid end further includes a second valve assembly and a second guide portion, the second valve assembly is located in the high-pressure chamber, and the second valve assembly is configured to communicate the pressure-alternating chamber with the high-pressure chamber upon being opened or configured to separate the pressure-alternating chamber from the high-pressure chamber upon being closed, the second valve assembly includes a second valve-body, a second seal, and a second valve seat; the second valve seat is annular and includes a second intermediate hole, the second intermediate hole is configured to allow fluid to flow therethrough, the second valve-body includes a second main portion, and a third guide rod and a fourth guide rod which are arranged at two sides of the second main portion, respectively; a part of the second seal is embedded in a second groove of the second main portion, the fluid end further includes a second spring and a cover, the second spring is located between the cover and the second main portion, the second guide portion includes a second guide seat and a third guide sleeve connected with the second guide seat, the second guide seat includes a second through hole, the second through hole is configured to allow fluid to flow therethrough, the third guide sleeve is configured to receive a part of the third guide rod so as to guide the second valve-body, the cover has a fourth guide sleeve, and the fourth guide sleeve is configured to receive a part of the fourth guide rod so as to guide the second valve-body.

For example, in some embodiments of the present disclosure, the second guide sleeve is provided with a drain hole, and the drain hole is configured to allow fluid to flow therethrough.

At least one embodiment of the present disclosure further provides a plunger pump, including any one of the fluid ends as described above.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not construed as any limitation to the present disclosure.

DETAILED DESCRIPTION

In order to make objectives, technical details, and advantages of the embodiments of the present disclosure more clear, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

For example, the plunger pump includes a power end and a fluid end, the power end is configured to transmit the energy of a prime mover to the fluid end, the power end mainly includes a housing, a crankshaft, a link rod, a crosshead and a pull rod, and the fluid end is configured to convert mechanical energy from the power end into pressure energy of fluid.

For example, the fluid end is an important component installed at the front end of the plunger pump, which converts low-pressure fluid into high-pressure liquid through the reciprocating motion of a plunger and the control of a valve-body, and the high-pressure liquid is accumulated in a manifold and pumped into the well. For example, the plunger pump having a fluid end can be applied to fracturing/cementing equipment in oil and gas fields, but is not limited thereto.

Figure 1A:
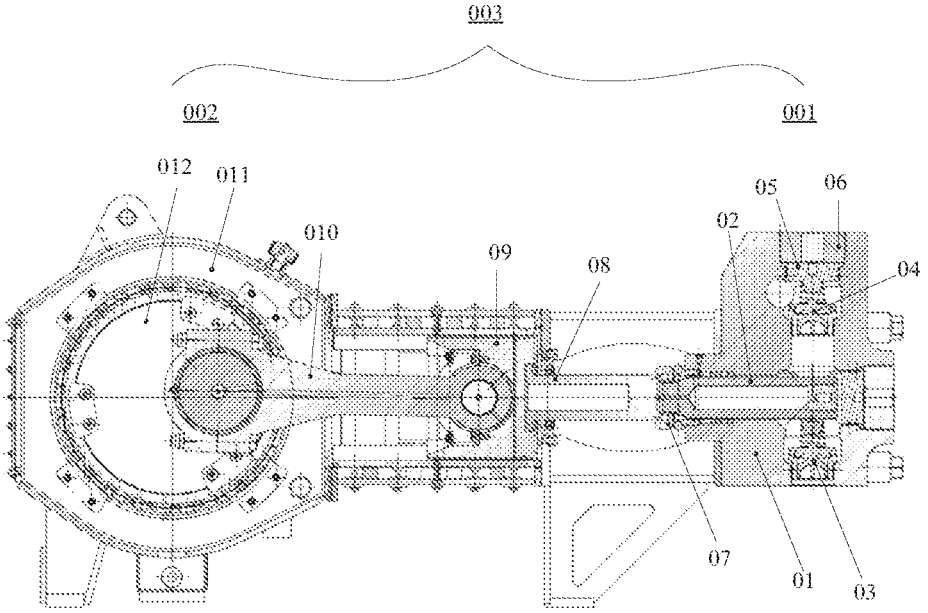
FIG. 1A Related Art
FIG. 1A is a sectional view of a plunger pump.
Figure 1B:
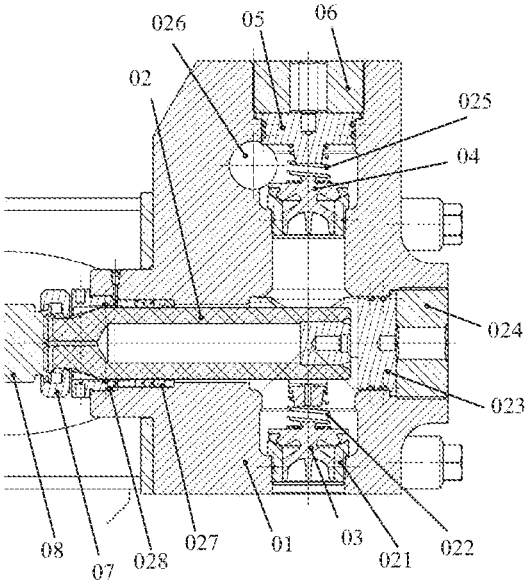
FIG. 1B is a schematic diagram of a fluid end in the plunger pump illustrated in FIG. 1A.
Figure 1C:
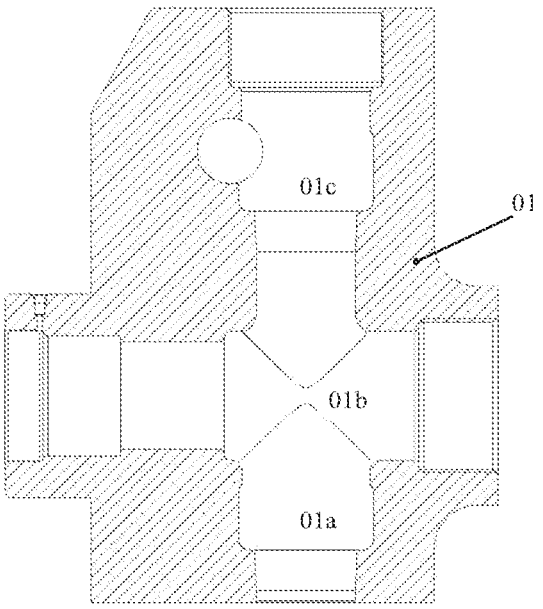
FIG. 1C is a schematic diagram of a valve casing in the fluid end illustrated in FIG. 1B.

FIG. 1A is a sectional view of a plunger pump. FIG. 1B is a schematic diagram of a fluid end in the plunger pump illustrated in FIG. 1A. FIG. 1C is a schematic diagram of a valve casing in the fluid end illustrated in FIG. 1B. As illustrated in FIG. 1A, the plunger pump 003 includes a power end 002 and a fluid end 001. As illustrated in FIGS. 1A and 1B, the fluid end 001 mainly includes a valve casing 01, a plunger 02, a valve assembly 03, a valve assembly 04, a seal assembly, a cover 05, and a nut 06. FIG. 1A further illustrates a clamp 07, a pull rod 08, a crosshead 09, a link rod 010, a housing 011, and a crankshaft 012. As illustrated in FIG. 1B, the fluid end 001 further includes a valve seat 021, a spring 022, a suction cover 023, a suction nut 024, a spring 025, an outlet bore 026, a packing assembly 027 for sealing, and a packing nut 028. FIG. 1C illustrates the cross shaped intersecting structure of the valve casing 01.

Generally, the operation principle of the plunger pump is as follows: under the drive of the prime mover, the crankshaft 012 of the power end 002 rotates to drive the link rod 010 and the crosshead 09 to reciprocate horizontally, and the crosshead 09 drives the plunger 02 to reciprocate horizontally in the valve casing 01 through the pull rod 08; when the plunger 02 moves backward, the interior volume of the valve casing 01 gradually increases, so as to form a local vacuum, and at this time, the valve assembly 03 is opened, the valve assembly 04 is closed, and the medium enters the inner chamber of the valve casing 01; when the plunger 02 moves backward to an extreme position, the inner chamber of the valve casing 01 is filled with the medium, and the liquid suction action is completed; when the plunger 02 moves forward, the interior volume of the valve casing 01 gradually decreases, the medium is squeezed and the pressure increases, and at this time, the valve assembly 04 is opened, the valve assembly 03 is closed, and the medium enters the outlet bore 026 under the action of the pressure; when the plunger 02 moves forward to an extreme position, the medium receiving space within the valve casing 01 is minimum, and the liquid discharge action ends. As the plunger 02 reciprocates continuously, the processes of liquid suction and liquid discharge are alternately carried out, and the high-pressure medium is continuously output.

As illustrated in FIGS. 1A-1C, the valve casing in the fluid end has a cross shaped intersecting structure. As illustrated in FIG. 1C, the inner chamber of the valve casing 02 is divided into a low-pressure zone 01*a*, an alternating zone 01*b* and a high-pressure zone 01*c* according to the pressure. However, an intersecting line is located right in the alternating zone 01*b*, and mechanical analysis illustrates that an obvious stress concentration at the intersecting line; coupled with the influence of alternating load, fatigue cracks easily occur at the intersecting line, which results in cracking and leakage of the valve casing 01 and frequent replacement of the valve casing on site. And the replacement is costly, time-consuming and laborious.

Figure 2A:
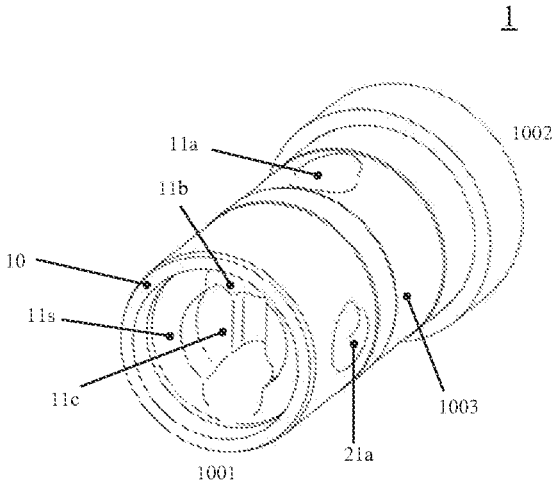
FIG. 2A is a stereogram of a fluid splitter provided by an embodiment of the present disclosure.
Figure 2B:
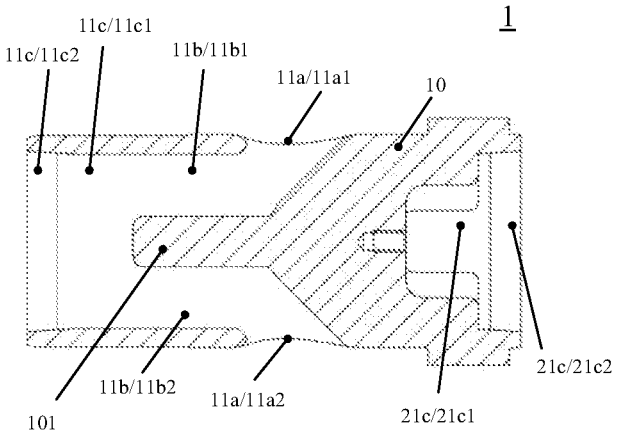
FIG. 2B is a sectional view of a fluid splitter (the section is a vertical plane passing through an axis of a body) provided by an embodiment of the present disclosure.
Figure 2C:
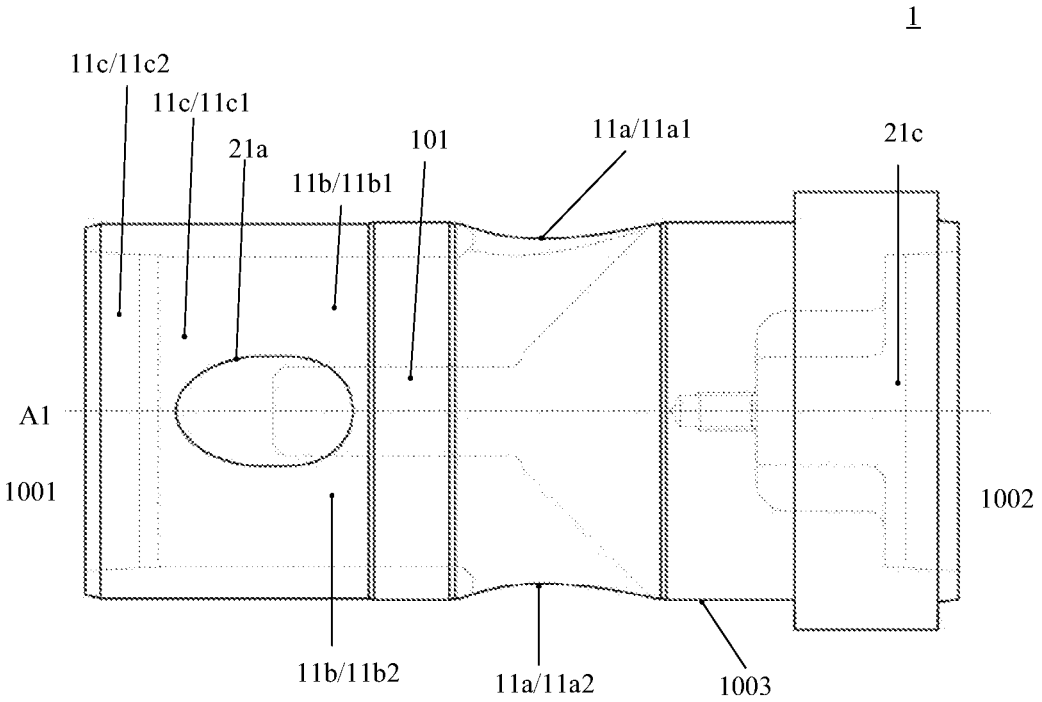
FIG. 2C is a perspective view of a fluid splitter (top perspective view of FIG. 2A) provided by an embodiment of the present disclosure.
Figure 2D:
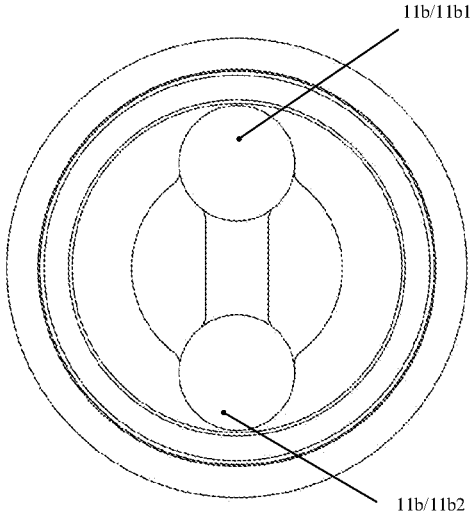
FIG. 2D is a left view of a fluid splitter provided by an embodiment of the present disclosure.
Figure 2E:
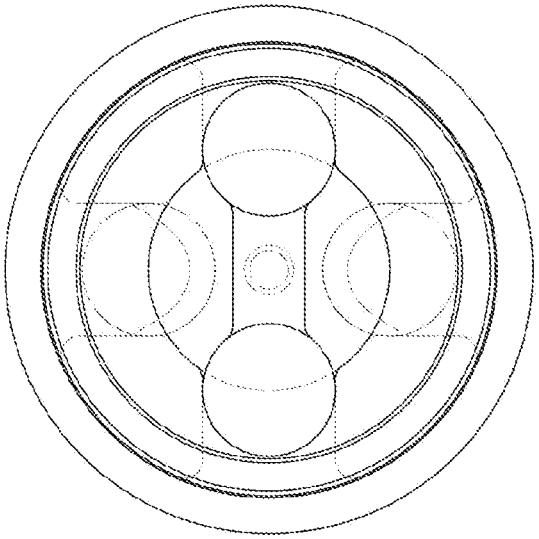
FIG. 2E is a left perspective view of a fluid splitter provided by an embodiment of the present disclosure.
Figure 3A:
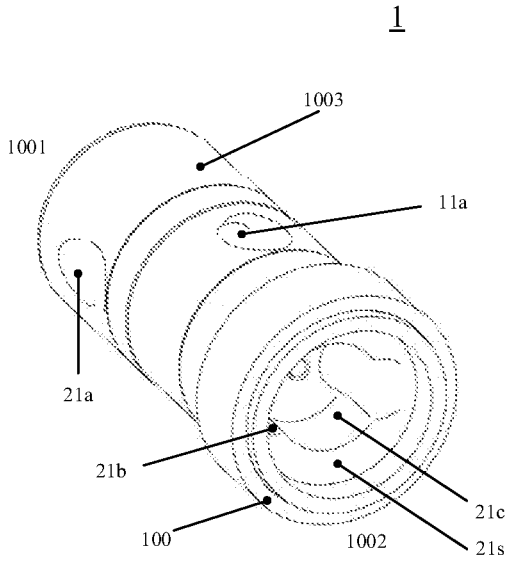
FIG. 3A is a stereogram of a fluid splitter provided by an embodiment of the present disclosure from another angle of view.
Figure 3B:
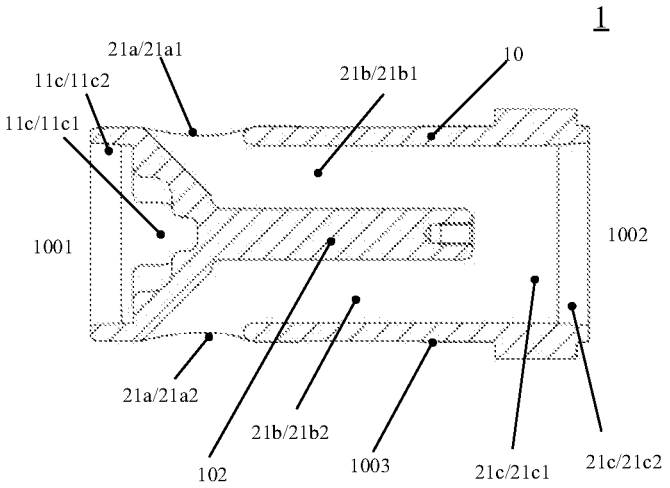
FIG. 3B is a sectional view of a fluid splitter (the section is a horizontal plane passing through an axis of a body) provided by an embodiment of the present disclosure.
Figure 3C:
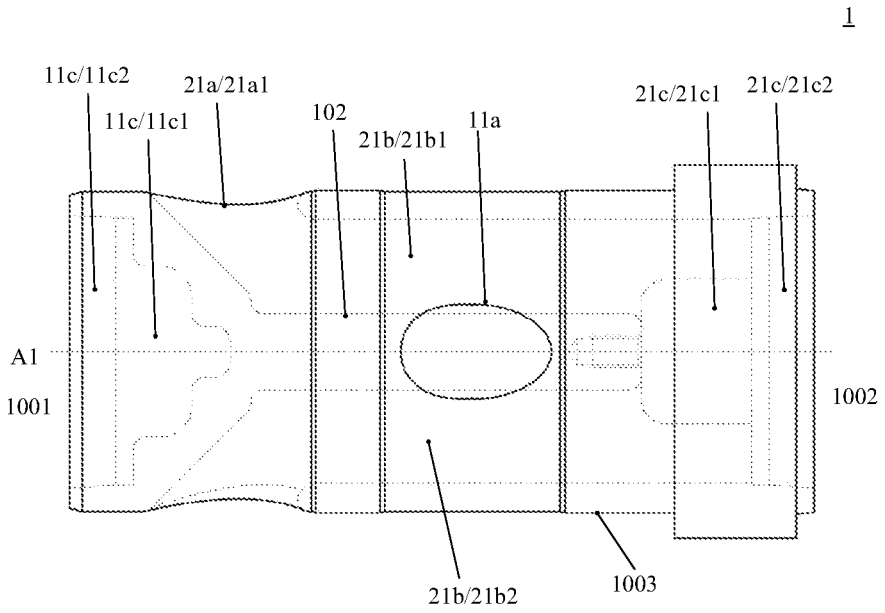
FIG. 3C is a perspective view of a fluid splitter (top perspective view of FIG. 3A) provided by an embodiment of the present disclosure.
Figure 3D:
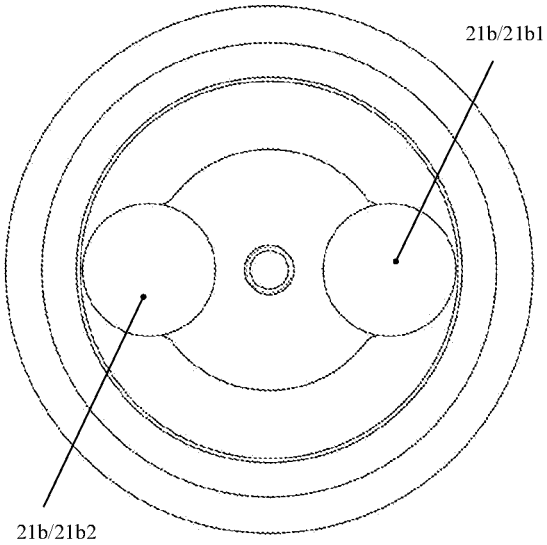
FIG. 3D is a right view of a fluid splitter provided by an embodiment of the present disclosure.
Figure 3E:
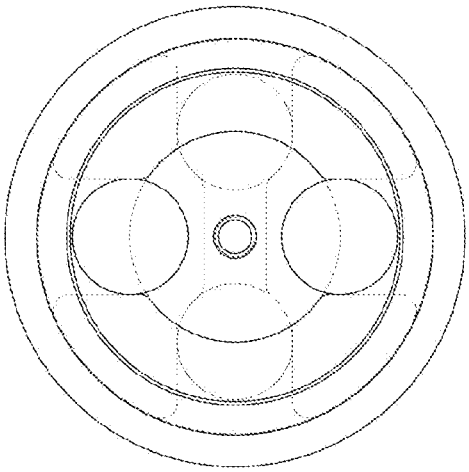
FIG. 3E is a right perspective view of a fluid splitter provided by an embodiment of the present disclosure.

FIGS. 2A-2E and FIGS. 3A-3E illustrate a fluid splitter provided by an embodiment of the present disclosure. FIG. 2A is a stereogram of a fluid splitter provided by an embodiment of the present disclosure. FIG. 2B is a sectional view of a fluid splitter (the section is a vertical plane passing through an axis of a body) provided by an embodiment of the present disclosure; FIG. 2C is a perspective view of a fluid splitter (top perspective view of FIG. 2A) provided by an embodiment of the present disclosure; FIG. 2D is a left view of a fluid splitter provided by an embodiment of the present disclosure; FIG. 2E is a left perspective view of a fluid splitter provided by an embodiment of the present disclosure; FIG. 3A is a stereogram of a fluid splitter provided by an embodiment of the present disclosure from another angle of view; FIG. 3B is a sectional view of a fluid splitter (the section is a horizontal plane passing through an axis of a body) provided by an embodiment of the present disclosure; FIG. 3C is a perspective view of a fluid splitter (top perspective view of FIG. 3A) provided by an embodiment of the present disclosure; FIG. 3D is a right view of a fluid splitter provided by an embodiment of the present disclosure; and FIG. 3E is a right perspective view of a fluid splitter provided by an embodiment of the present disclosure.

As illustrated in FIG. 2A and FIG. 3A, at least one embodiment of the present disclosure provides a fluid splitter 1, and the fluid splitter 1 includes: a body 10, a first opening 11*a*, a first channel 11*b*, a first cavity 11*c*, a second opening 21*a*, a second channel 21*b*, and a second cavity 21*c*. FIG. 2A and FIG. 3A are drawings of the same fluid splitter from different angle of views.

As illustrated in FIG. 2A and FIG. 3A, in the fluid splitter provided by at least one embodiment of the present disclosure, the body 10 has a shape of column, and the body 10 includes a first end 1001, a second end 1002, and a side surface 1003 connecting the first end 1001 and the second end 1002. For example, the body 10 is cylindrical. The embodiment of the present disclosure is described with reference to the case where the body 10 is cylindrical, by way of example.

As illustrated in FIG. 2A, the first cavity 11*c* is located at the first end 1001; and the second cavity 21*c* is located at the second end 1002. As illustrated in FIG. 2A, the first cavity 11*c* is an open cavity, and the first cavity 11*c* is recessed into the body 10 at the first end 1001. As illustrated in FIG. 3A, the second cavity 21*c* is an open cavity, and the second cavity 21*c* is recessed into the body 10 at the second end 1002. That is to say, whether it is the first cavity or the second cavity, a cavity refers to that the cavity is formed by recessing from an end of the body into the body.

As illustrated in FIG. 2A and FIG. 3A, the first opening 11*a* is located at the side surface 1003 of the body 10, and the second opening 21*a* is located at the side surface 1003 of the body 10.

As illustrated in FIGS. 2A-2C, the first channel 11*b* is communicated with the first opening 11*a* and the first cavity 11*c*, respectively. The first channel 11*b* extends from the first opening 11*a* to the first cavity 11*c*, and is configured to allow fluid to flow therethrough. The fluid is the medium mentioned above.

As illustrated in FIGS. 3A-3C, the second channel 21*b* is communicated with the second opening 21*a* and the second cavity 21*c*, respectively. The second channel 21*b* extends from the second opening 21*a* to the second cavity 21*c*, and is configured to allow fluid to flow therethrough.

For example, the fluid is a flowable substance. For example, the fluid includes fracturing fluid, and the fracturing fluid includes sand-carrying fluid. The sand-carrying fluid includes water, sand and additives. For example, the sand includes quartz sand. For example, the fluid also includes cement mortar. Usually, the cement mortar is used for cementing. The type and viscosity of the fluid are not limited in the embodiment of the present disclosure. The fluid splitter provided by the embodiment of the present disclosure can be applied to fracturing process and cementing process, but is not limited thereto, and can also be applied to any other field which requires fluid splitting.

In the fluid splitter provided by at least one embodiment of the present disclosure, the first opening 11*a* is located at the side surface 1003 of the body 10, and the second opening 21*a* is also located at the side surface 1003 of the body 10, thus, it is beneficial to form the first opening 11*a* with a relatively large aperture and the second opening 21*a* with a relatively large aperture, and also to form the first opening 11*a* and the second opening 21*b* with the same size or approximately the same size. The first opening 11*a* and the second opening 21*a* are large in size, i.e., large in aperture, which is beneficial for fluid to enter the fluid splitter and to discharge from the fluid splitter without clogging. The first opening 11*a* and the second opening 21*a*, which are equal or approximately equal in size, are beneficial to the balance between the inlet fluid and the outlet fluid of the fluid splitter. That is, the amount of fluid entering the fluid splitter and the amount of fluid discharging from the fluid splitter are substantially the same. For example, in the case where the fluid splitter is applied in a plunger pump, the amount of fluid entering the fluid splitter when the plunger moves backward and the amount of fluid discharging from the fluid splitter when the plunger moves forward are substantially the same.

For example, as illustrated in FIG. 2A and FIG. 3A, in order to facilitate the arrangement of the first channel 11*b* and the second channel 21*b*, the first opening 11*a* is closer to the second end 1002 than the second opening 21*a*, and the second opening 21*a* is closer to the first end 1001 than the first opening 11*a*.

For example, as illustrated in FIG. 2B, FIG. 2C, FIG. 3B and FIG. 3C, in order to facilitate the arrangement of the first opening 11*a* and the second opening 21*a*, a length of the first channel 11*b* in an axial direction of the body 10 is less than a length of the second channel 21*b* in the axial direction of the body 10. For example, in the embodiment of the present disclosure, the axial direction of the body 10 is an extending direction of the central axis of the body. For example, the central axis of the body can be the rotation axis of a cylinder.

For example, as illustrated in FIG. 2B, FIG. 2C, FIG. 3B and FIG. 3C, in order to facilitate fluid entry and fluid discharge, the first opening 11*a* and the second opening 21*a* are located at different positions in the axial direction of the body 10.

For example, as illustrated in FIG. 2A and FIG. 3A, in order to facilitate fluid entry and fluid discharge, the first opening 11*a* and the second opening 21*a* face towards different directions, and in order to facilitate the balance between the inlet fluid and the outlet fluid, the first opening 11*a* and the second opening 21*a* have the same size.

For example, as illustrated in FIGS. 2A-2C and FIGS. 3A-3C, in order to facilitate splitting, the first channel 11*b* is not communicated with the second channel 21*b*, and the first cavity 11*c* is not communicated with the second cavity 21*c*.

For example, as illustrated in FIGS. 2A-2C, the body 10 includes a first flow guide portion 101, and a plurality of first channels 11*b* are provided, that is, the fluid splitter includes a plurality of first channels 11*b*. The plurality of first channels 11*b* are separated by the first flow guide portion 101, and the plurality of first channels 11*b* are converged at the first cavity 11*c*. The plurality of first channels 11*b* are all communicated with the first cavity 11*c*. FIGS. 2A-2C illustrate two first channels 11*b*, namely one first channel 11*b*1 and another first channel 11*b*2. In some other embodiments, there may be one or more than two first channels 11*b*, which can be set as required.

For example, as illustrated in FIGS. 2A-2C, a plurality of first openings 11*a* are provided, that is, the fluid splitter 1 includes a plurality of first openings 11*a*. The plurality of first channels 11*b* are in one-to-one correspondence with the plurality of first openings 11*a*, the plurality of first openings 11*a* are distributed in the circumferential direction of the body 10, and the plurality of first openings 11*a* are located at the same position in the axial direction of the body 10. For example, the plurality of first openings 11*a* can be uniformly distributed in the circumferential direction of the body 10. FIGS. 2A-2C illustrate two first openings 11*a*, namely, one first opening 11*a*1 and another first opening 11*a*2. In some other embodiments, there may be one or more than two first openings 11*a*, which can be set as required. For example, the plurality of first openings 11*a* are located on the circumference of a same sectional circle of the body 10.

For example, the plurality of first channels 11*b* being in one-to-one correspondence with the plurality of first openings 11*a* refers to that the number of the plurality of first channels 11*b* is the same as the number of the plurality of first openings 11*a*, and one first opening 11*a* corresponds to one first channel 11*b*.

For example, as illustrated in FIG. 3A, the body 10 includes a second flow guide portion 102, and a plurality of second channels 21*b* are provided, that is, the fluid splitter 1 includes a plurality of second channels 21*b*. The plurality of second channels 21*b* are separated by the second flow guide portion 102, and the plurality of second channels 21*b* are converged at the second cavity 21*c*. The plurality of second channels 21*b* are all communicated with the second cavity 21*c*. FIGS. 3A-3C illustrate two second channels 21*b*, namely one second channel 21*b*1 and another second channel 21*b*2. In some other embodiments, there may be one or more than two second channels 21*b*, which can be set as required.

For example, as illustrated in FIGS. 3A-3C, a plurality of second openings 21*a* are provided, that is, the fluid splitter 1 includes a plurality of second openings 21*a*. The plurality of second channels 21*b* are in one-to-one correspondence with the plurality of second openings 21*a*, the plurality of second openings 21*a* are distributed in the circumferential direction of the body 10, and the plurality of second openings 21*a* are located at the same position in the axial direction of the body 10. For example, the plurality of second openings 21*a* can be uniformly distributed in the circumferential direction of the body 10. FIGS. 3A-3C illustrate two second openings 21*a*, namely, one second opening 21*a*1 and another second opening 21*a*2. In some other embodiments, there may be one or more than two second openings 21*a*, which can be set as required. For example, the plurality of second openings 21*a* are located on the circumference of a same sectional circle of the body 10.

For example, the plurality of second channels 21*b* being in one-to-one correspondence with the plurality of second openings 21*a* refers to that the number of the plurality of second channels 21*b* is the same as the number of the plurality of second openings 21*a*, and one second opening 21*a* corresponds to one second channel 21*b*.

For example, as illustrated in FIG. 2C and FIG. 3C, the fluid splitter 1 includes a central axis A1. In some embodiments, as illustrated in FIG. 2C, the two first channels 11*b* are arranged symmetrically with respect to the central axis A1. In some embodiments, as illustrated in FIG. 3C, the two second channels 21*b* are arranged symmetrically with respect to the central axis A1.

For example, as illustrated in FIG. 2C, the first channel 11*b* extends from a position close to the side surface 1003 to a position close to the central axis A1 and then extends in the extending direction of the central axis A1. For example, as illustrated in FIG. 3C, the second channel 21*b* extends from a position close to the side surface 1003 to a position close to the central axis A1 and then extends in the extending direction of the central axis A1.

For example, in some embodiments, the fluid splitter 1 has an axisymmetric structure with respect to the central axis A1.

For example, as illustrated in FIG. 2A, the first cavity 11*c* includes a first step surface 11*s*. As illustrated in FIG. 2A and FIG. 2C, the first step surface 1 is divides the first cavity 11*c* into two first sub-cavities having different areas in radial section, and the first step surface 11*s* can be configured to place other components. As illustrated in FIG. 3A, the second cavity 21*c* includes a second step surface 21*s*. As illustrated in FIG. 3C, the second step surface 21*s* divides the second cavity 21*c* into two second sub-cavities having different areas in radial section, and the second step surface 21*s* can be configured to place other components. The first step surface 11*s* and the second step surface 21*s* both play a role of position limiting. FIG. 2B illustrates one second sub-cavity 21*c*1 and another second sub-cavity 21*c*2. For example, as illustrated in FIG. 2B, the second sub-cavity 21*c*1 is communicated with the second sub-cavity 21*c*2. FIG. 3B illustrates one first sub-cavity 11*c*1 and another first sub-cavity 11*c*2. For example, as illustrated in FIG. 3B, the first sub-cavity 11*c*1 is communicated with the first sub-cavity 11*c*2.

Figure 4:
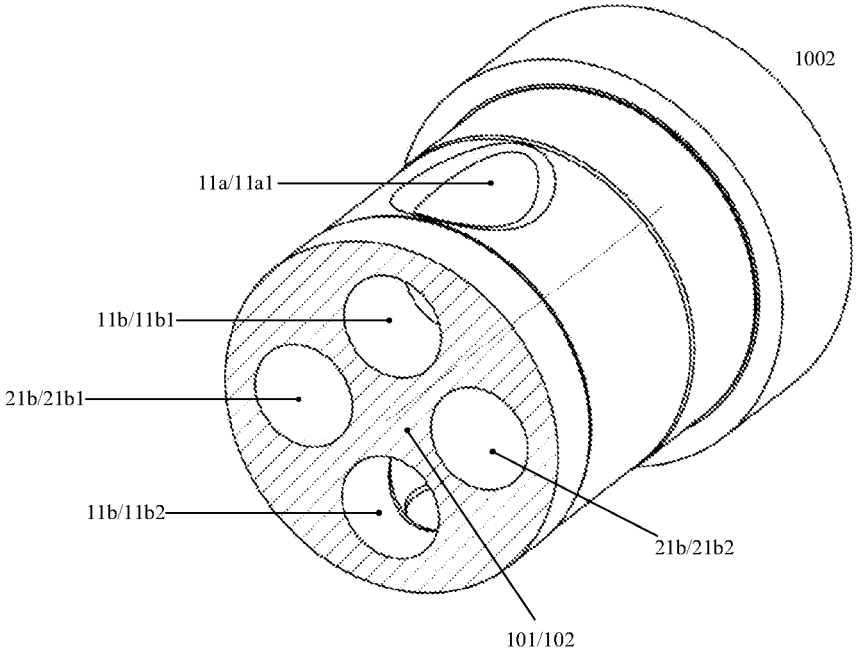
FIG. 4 is a schematic diagram of the fluid splitter illustrated in FIG. 2A or FIG. 3A in a section perpendicular to the axis of the body.

FIG. 4 is a schematic diagram of the fluid splitter illustrated in FIG. 2A or FIG. 3A in a section perpendicular to the axis of the body. FIG. 4 illustrates the first flow guide portion 101 and the second flow guide portion 102. For example, the first flow guide portion 101 and the second flow guide portion 102 can be an integrated structure, and a length of the first flow guide portion 101 in the axial direction of the body is less than a length of the second flow guide portion 102 in the axial direction of the body. In the case where the first channel 11*b* is a fluid inlet channel and the second channel 21*b* is a fluid outlet channel, FIG. 4 illustrates two fluid inlet channels and two fluid outlet channels. Referring to FIGS. 2A-2C, FIGS. 3A-3C and FIG. 4, the first channel 11*b* is not communicated with the second channel 21*b*, and the first cavity 11*c* is not communicated with the second cavity 21*c*, so as to facilitate the fluid entering the fluid splitter and discharging from the fluid splitter. One of the first channel 11*b* and the second channel 21*b* is a fluid inlet channel, and the other of the first channel 11*b* and the second channel 21*b* is a fluid outlet channel.

For example, as illustrated in FIG. 4, in some embodiments, in order to facilitate manufacturing and the balance of the inlet fluid and the outlet fluid, the apertures of the two first channels 11*b* are the same, the apertures of the two second channels 21*b* are the same, and the apertures of the first channel 11*b* and the second channel 21*b* are the same.

For example, the fluid splitter can be made of alloy steel, but is not limited thereto. The fluid splitter provided by the embodiment of the present disclosure can be manufactured according to its structure by a common manufacturing method.

Figure 5:
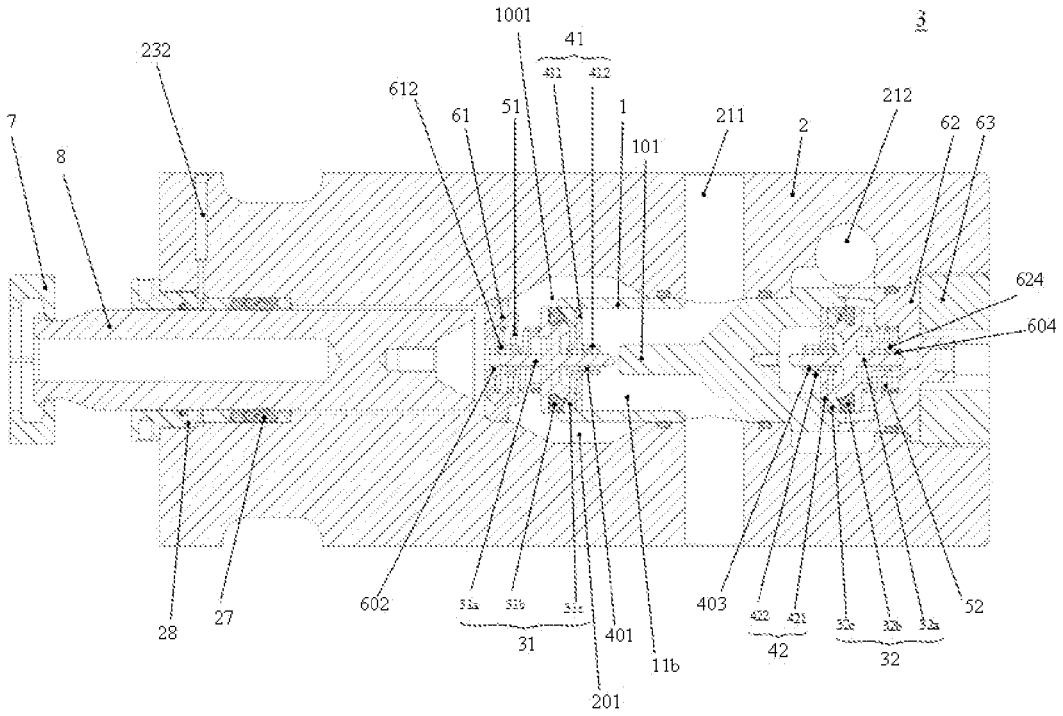
FIG. 5 is a front view of a fluid end provided by at least one embodiment of the present disclosure.
Figure 6:
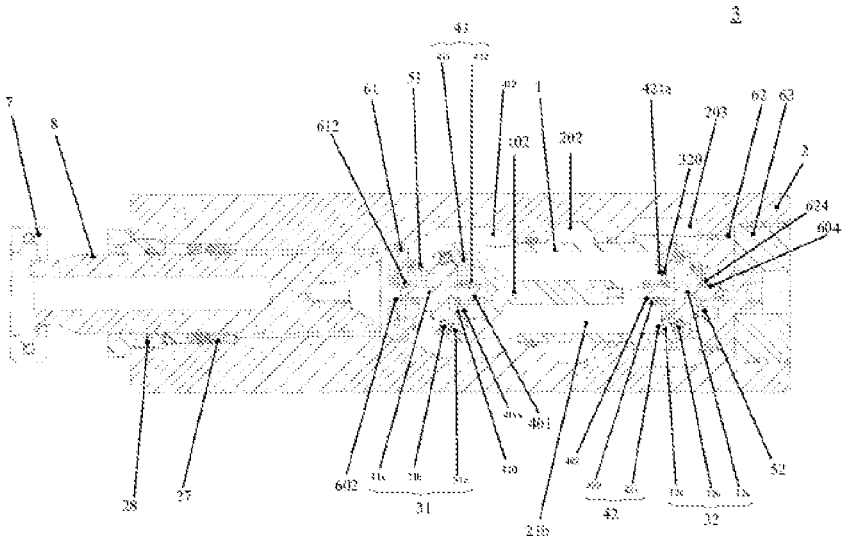
FIG. 6 is a top view of a fluid end provided by at least one embodiment of the present disclosure.
Figure 7:
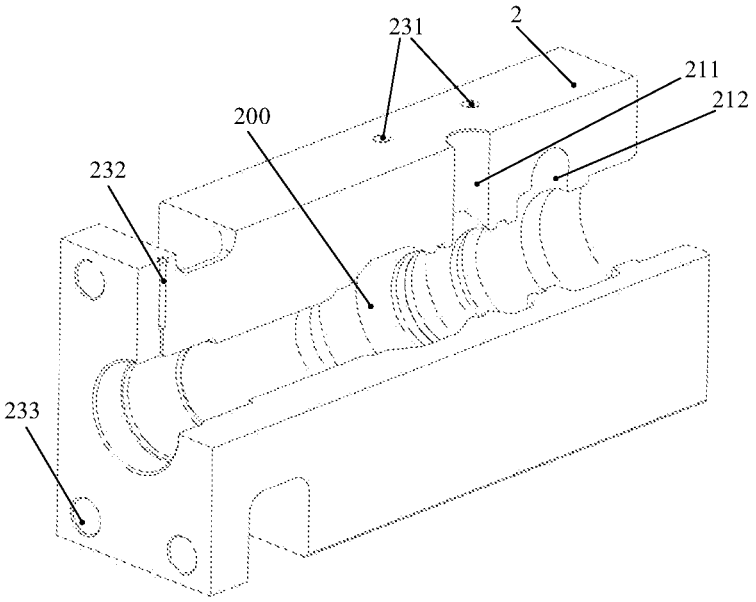
FIG. 7 is a structural diagram of a valve casing of a fluid end provided by at least one embodiment of the present disclosure.
Figure 8:
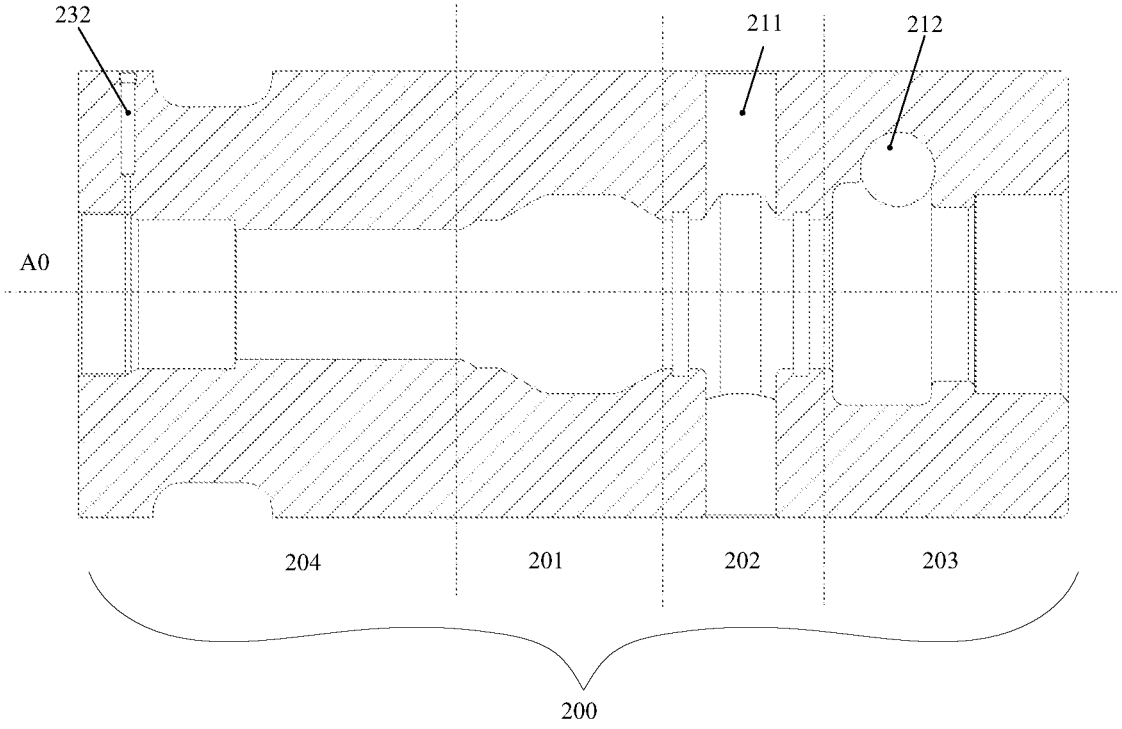
FIG. 8 is a sectional view of a valve casing of a fluid end provided by at least one embodiment of the present disclosure.
Figure 9A:
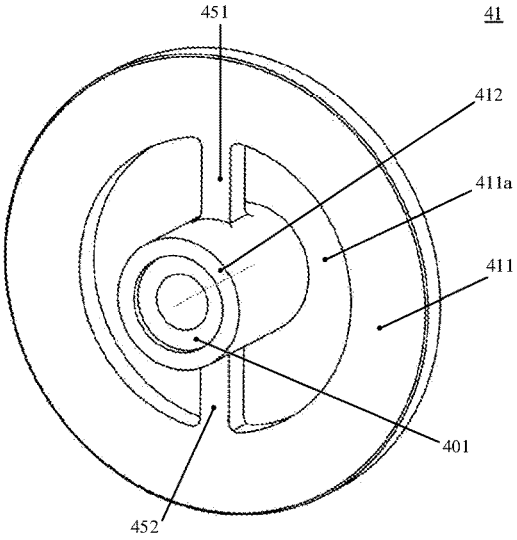
FIG. 9A is an assembly diagram of a first guide portion and a first guide auxiliary member in a fluid end provided by at least one embodiment of the present disclosure.
Figure 9B:
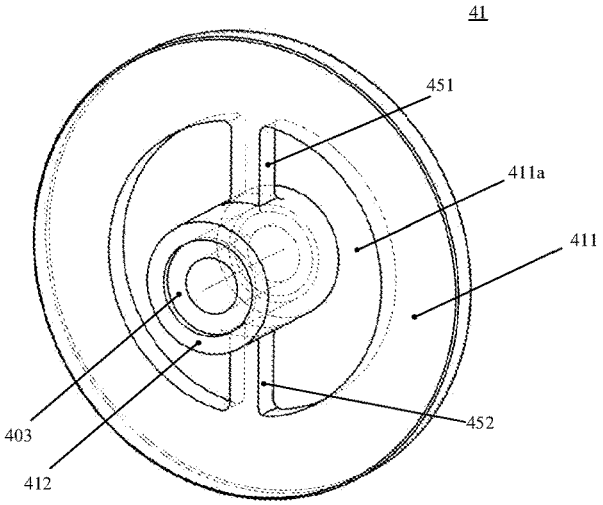
FIG. 9B is a perspective stereogram of a first guide portion and a first guide auxiliary member in a fluid end provided by at least one embodiment of the present disclosure.
Figure 10:
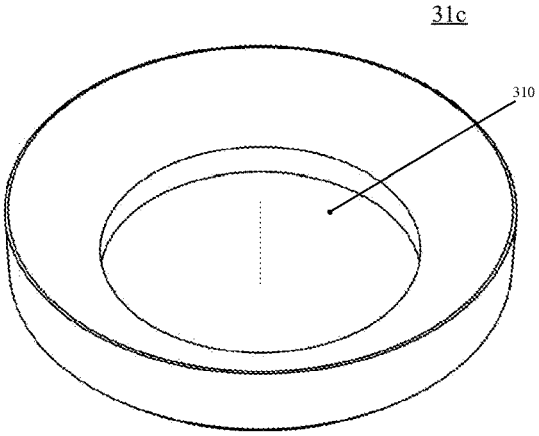
FIG. 10 is a stereogram of a first valve seat in a fluid end provided by at least one embodiment of the present disclosure.
Figure 11A:
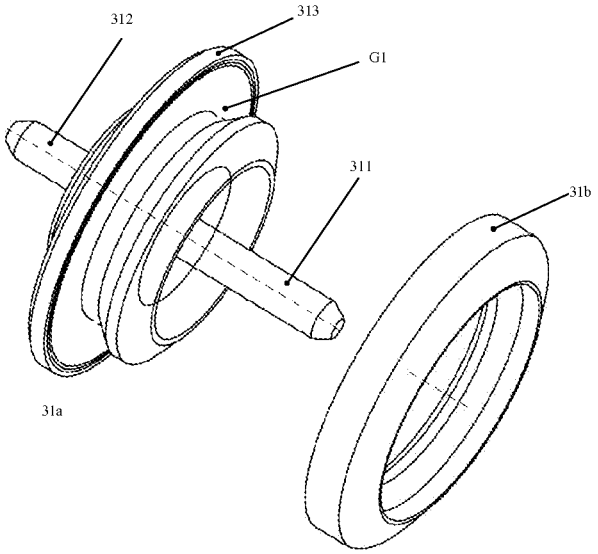
FIG. 11A is an exploded view of a first valve-body and a first seal in a fluid end provided by at least one embodiment of the present disclosure.
Figure 11B:
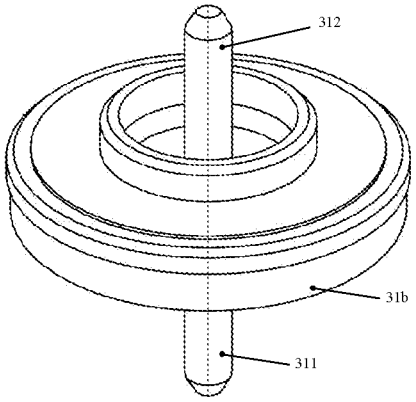
FIG. 11B is a stereogram of a first valve-body and a first seal in a fluid end provided by at least one embodiment of the present disclosure.
Figure 11C:
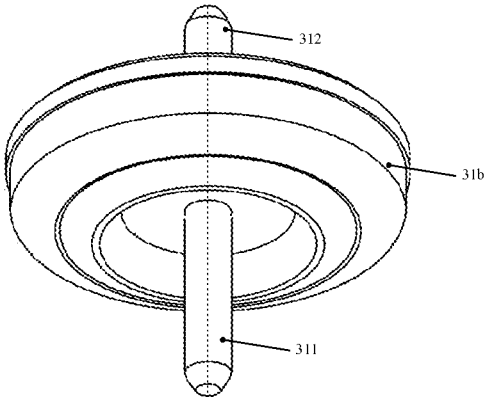
FIG. 11C is a stereogram of a first valve-body and a first seal in a fluid end provided by at least one embodiment of the present disclosure from another angle of view.
Figure 12:
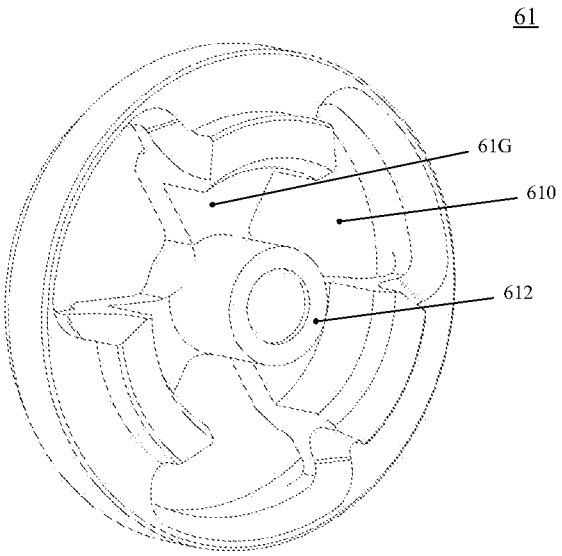
FIG. 12 is a stereogram of a spring seat in a fluid end provided by at least one embodiment of the present disclosure.
Figure 13A:
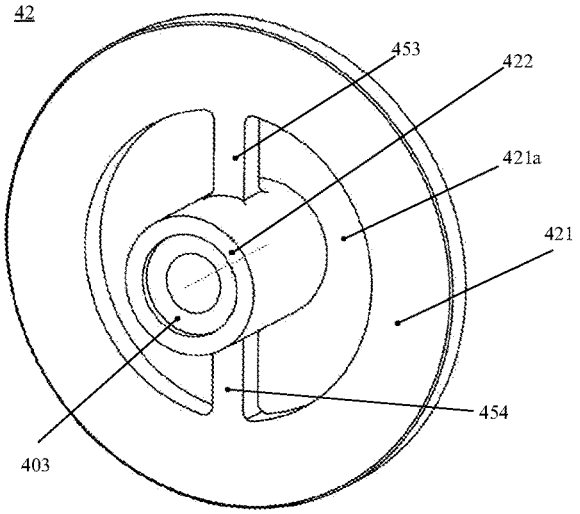
FIG. 13A is an assembly diagram of a second guide portion and a third guide auxiliary member in a fluid end provided by at least one embodiment of the present disclosure.
Figure 13B:
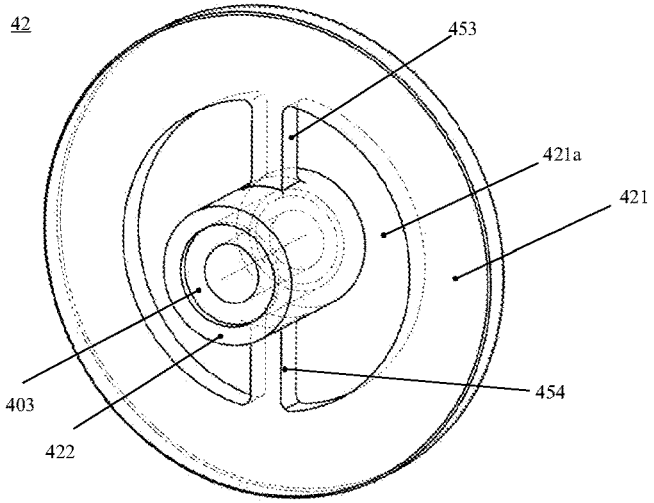
FIG. 13B is a perspective stereogram of a second guide portion and a third guide auxiliary member in a fluid end provided by at least one embodiment of the present disclosure.
Figure 14:
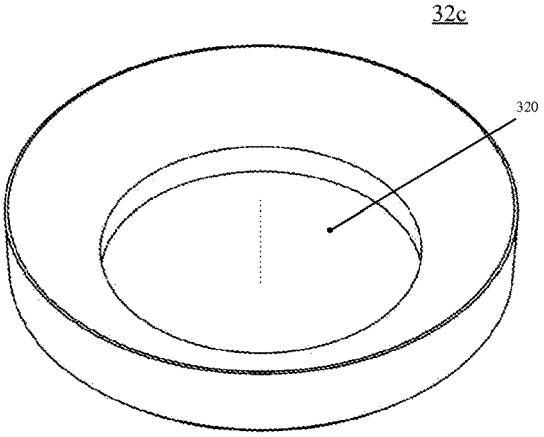
FIG. 14 is a stereogram of a second valve seat in a fluid end provided by at least one embodiment of the present disclosure.
Figure 15A:
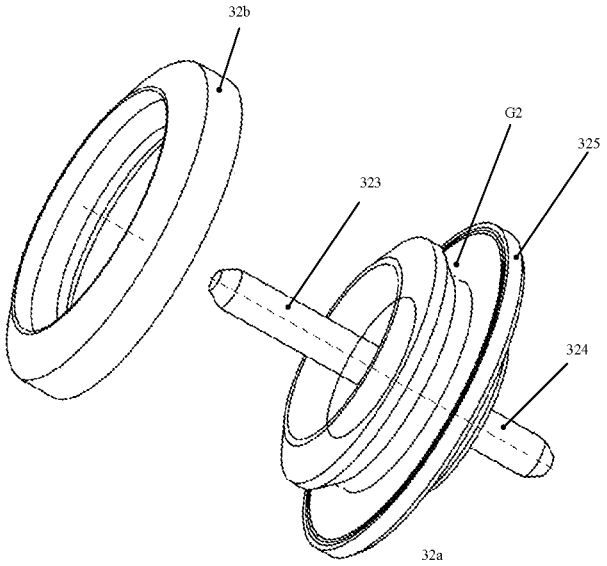
FIG. 15A is an exploded view of a second valve-body and a second seal in a fluid end provided by at least one embodiment of the present disclosure.
Figure 15B:
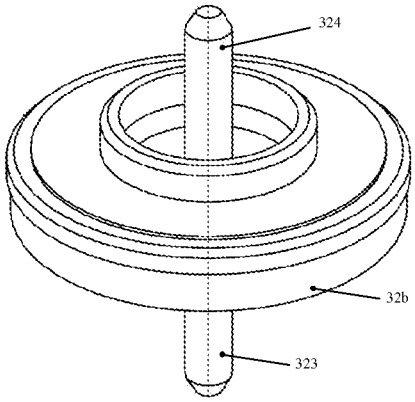
FIG. 15B is a stereogram of a second valve-body and a second seal in a fluid end provided by at least one embodiment of the present disclosure.
Figure 15C:
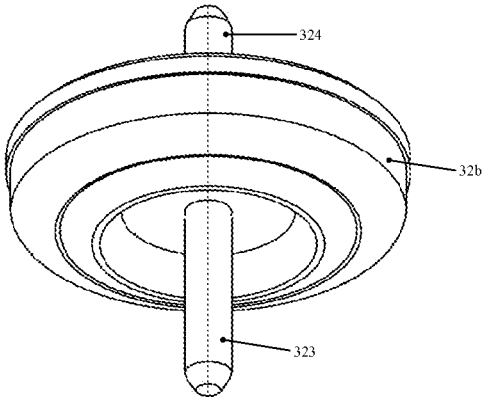
FIG. 15C is a stereogram of a second valve-body and a second seal in a fluid end provided by at least one embodiment of the present disclosure from another angle of view.
Figure 16:
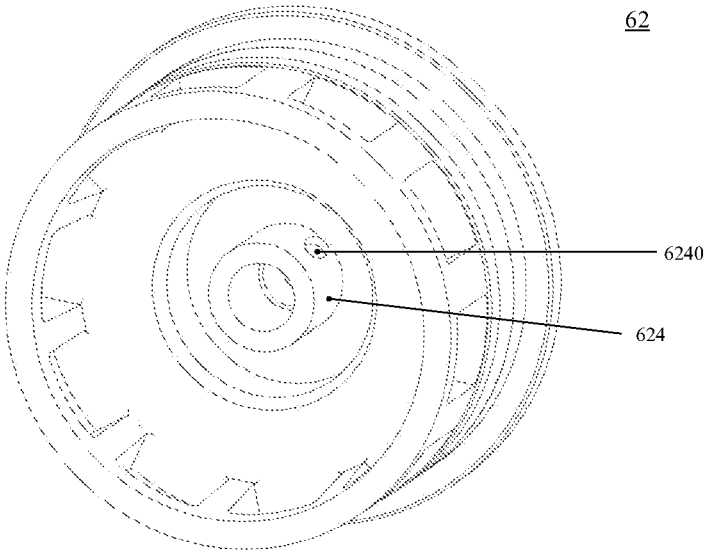
FIG. 16 is a stereogram of a cover in a fluid end provided by at least one embodiment of the present disclosure.
Figure 17:
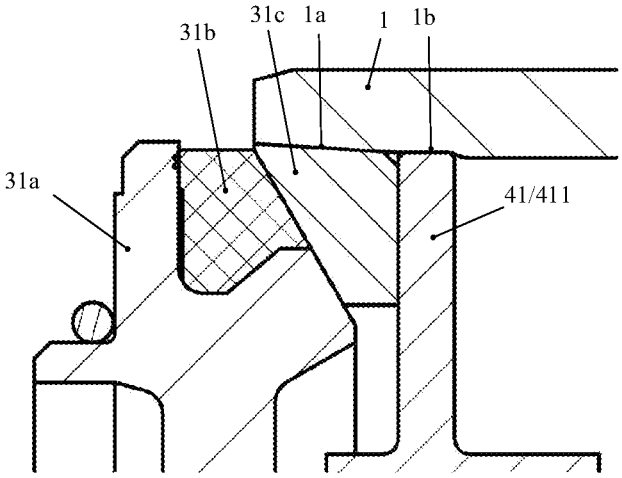
FIG. 17 is a schematic partial diagram of a fluid splitter, a first valve assembly, a first valve seat, and a first guide portion in a fluid end provided by at least one embodiment of the present disclosure.

FIG. 5 is a front view of a fluid end provided by at least one embodiment of the present disclosure. FIG. 6 is a top view of a fluid end provided by at least one embodiment of the present disclosure. FIG. 7 is a structural diagram of a valve casing of a fluid end provided by at least one embodiment of the present disclosure. FIG. 8 is a sectional view of a valve casing of a fluid end provided by at least one embodiment of the present disclosure. FIG. 9A is an assembly diagram of a first guide portion and a first guide auxiliary member in a fluid end provided by at least one embodiment of the present disclosure. FIG. 9B is a perspective stereogram of a first guide portion and a first guide auxiliary member in a fluid end provided by at least one embodiment of the present disclosure. FIG. 10 is a stereogram of a first valve seat in a fluid end provided by at least one embodiment of the present disclosure. FIG. 11A is an exploded view of a first valve-body and a first seal in a fluid end provided by at least one embodiment of the present disclosure. FIG. 11B is a stereogram of a first valve-body and a first seal in a fluid end provided by at least one embodiment of the present disclosure. FIG. 11C is a stereogram of a first valve-body and a first seal in a fluid end from another angle of view provided by at least one embodiment of the present disclosure. FIG. 12 is a stereogram of a spring seat in a fluid end provided by at least one embodiment of the present disclosure. FIG. 13A is an assembly diagram of a second guide portion and a third guide auxiliary member in a fluid end provided by at least one embodiment of the present disclosure. FIG. 13B is a perspective stereogram of a second guide portion and a third guide auxiliary member in the fluid end provided by at least one embodiment of the present disclosure. FIG. 14 is a stereogram of a second valve seat in a fluid end provided by at least one embodiment of the present disclosure. FIG. 15A is an exploded view of a second valve-body and a second seal in a fluid end provided by at least one embodiment of the present disclosure. FIG. 15B is a stereogram of a second valve-body and a second seal in a fluid end provided by at least one embodiment of the present disclosure. FIG. 15C is a stereogram of a second valve-body and a second seal in a fluid end provided by at least one embodiment of the present disclosure from another angle of view. FIG. 16 is a stereogram of a cover in a fluid end provided by at least one embodiment of the present disclosure. FIG. 17 is a schematic partial diagram of a fluid splitter, a first valve assembly, a first valve seat, and a first guide portion in a fluid end provided by at least one embodiment of the present disclosure. The fluid end provided by the embodiment of the present disclosure will be described in detail below with reference to FIGS. 5-17.

As illustrated in FIG. 5 and FIG. 6, the fluid end 3 includes a valve casing 2 and any one of the fluid splitters 1 described above. The valve casing 2 includes an inner chamber 200, and the fluid splitter 1 is located in the inner chamber 200.

For example, as illustrated in FIG. 7, the valve casing 2 includes an inner chamber 200. For example, as illustrated in FIG. 7, the valve casing 2 further includes an inlet bore 211, an outlet bore 212, an inlet pipe connection bore 231, a grease injection bore 232, and a connection bore 233. Referring to FIG. 5, in some embodiments, in order to facilitate fluid flow, the aperture of the inlet hole 211 is the same as the diameter of the first opening 11*a* of the fluid splitter 1.

For example, as illustrated in FIG. 8, the inner chamber 200 includes a pressure-alternating chamber 201, a low-pressure chamber 202, and a high-pressure chamber 203; and the pressure-alternating chamber 201, the low-pressure chamber 202, and the high-pressure chamber 203 are sequentially arranged in the axial direction of the valve casing 2. The second end 1002 is located in the high-pressure chamber 203, the first opening 11*a* is located in the low-pressure chamber 202, the first end 1001 and the second opening 21*a* are located in the pressure-alternating chamber 201, the second opening 21*a* is communicated with the pressure-alternating chamber 201, the valve casing 2 includes an inlet bore 211 and an outlet bore 212, the inlet bore 211 is communicated with the first opening 11*a*, and the outlet bore 212 is communicated with the high-pressure chamber 203. For example, the axial direction of the valve casing 2 is an extending direction of a central axis A0 of the valve casing 2. As illustrated in FIG. 8, the axial direction of the valve casing 2 is horizontal. For example, in some embodiments, the central axis A1 of the fluid splitter (referring to FIG. 2C and FIG. 3C) coincides with the central axis A0 of the valve casing 2 (referring to FIG. 8).

For example, referring to FIGS. 5-6, the fluid end 3 further includes a plunger 8. Referring to FIG. 8, the inner chamber 200 further includes a plunger chamber 204, and the plunger chamber 204 is configured to receive the plunger 8. Referring to FIG. 8, the plunger chamber 204, the pressure-alternating chamber 201, the low-pressure chamber 202, and the high-pressure chamber 203 are sequentially arranged in the axial direction of the valve casing 2, and the valve casing 2 of the fluid end 3 has no intersecting line, so that the fluid end is a straight-through fluid end. The valve casing in the straight-through fluid end is easy to be manufactured, compact in structure, small in drainage resistance and light in weight.

For example, the pressure-alternating chamber 201 can also be referred to as a first chamber, the low-pressure chamber 202 can also be referred to as a second chamber, the high pressure-cavity 203 can also be referred to as a third chamber, and the plunger chamber 204 can also be referred to as a fourth chamber.

The fluid end provided by the embodiment of the present disclosure is a straight-through fluid end, which can solve the cracking problem of the valve casing caused by stress concentration at the intersecting line and can prolong the service life of the valve casing. In other words, the region bearing alternating load within the valve casing is "transferred", and the position where cracks easily occur is "transferred" from the valve casing to another component, and the component can be replaced in case of damage, thus prolonging the service life of the valve casing, After all, the replacement cost of the valve casing is high, time-consuming, and laborious. That is, the fluid end provided by the embodiment of the present disclosure is a straight-through fluid end, and the first end 1001 of the fluid splitter 1 is located in the pressure-alternating chamber 201 and can bear the alternating load; the position where cracks easily occur is transferred to the fluid splitter 1, and when the fluid splitter 1 is damaged, all that need to do is to replace the fluid splitter, thus better protecting the valve casing, prolonging the service life of the valve casing, reducing the number of replacement of the valve casing, reducing the cost, and saving time. For example, the fluid end provided by the embodiment of the present disclosure is small in volume, and can be connected with the power end of a plunger pump in the existing art or connected with a linear motor by means of clamps, bolts or the like.

For example, referring to FIGS. 2A-2C, FIGS. 3A-3C and FIGS. 4-6, the fluid splitter is manufactured with two first channels 11*b* and two second channels 21*b*, which can allow high-pressure liquid and low-pressure liquid to flow therethrough, respectively. The two first channels are suction channels which allow low-pressure fluid to flow therethrough, the two second channels are fluid outlet channels which allow high-pressure fluid to flow therethrough, and the two first channels and two second channels are evenly distributed with respect to the axis of the fluid splitter. Referring to FIGS. 5-8, the low-pressure chamber, the pressure-alternating chamber, and the high-pressure chamber can be separated from each other by the fluid splitter 1, two seal rings are provided between the fluid splitter 1 and the valve casing 2 for sealing and isolating.

For example, as illustrated in FIG. 8, the inner chamber 200 is a horizontal chamber, and the inner chamber is divided into a plunger chamber 204, a pressure-alternating chamber 201, a low-pressure chamber 202, and a high-pressure chamber 203 from left to right. There is no intersecting line in the pressure-alternating chamber 201, and the inner chamber 200 has a smooth transition, so the valve casing 2 is not easy to crack due to stress concentration. For example, as illustrated in FIG. 7, the valve casing 2 is provided with a connection bore 233, a grease injection bore 232, an inlet bore 211, and an outlet bore 212. For example, the valve casing 2 can be a single-cylinder valve casing or a multi-cylinder valve casing. For example, the number of the inlet bores 211 is equal to the number of the first openings 11*a*. That is, one first opening 11*a* corresponds to one inlet bore 211.

For example, the connection bores 233 of the fluid end are used to fasten the fluid end to the equipment, and are evenly distributed with respect to the axis of the inner chamber, and a groove is reserved at an outer side of the bore for placing a bolt. The inlet pipe connection bores 231 are used to fasten an inlet manifold to the fluid end 3, and are evenly distributed with respect to the axis of the inlet bore. The upper and lower sides of the valve casing 2 are symmetrically distributed.

The inlet bore is a suction channel through which the low-pressure medium enters the valve casing 2. The suction channel can be in the form of single channel, double channels, four channels, etc., but is not limited thereto. The outlet bore is the fluid outlet bore of the high-pressure medium discharging from the valve casing 2, and can be arranged in the center or away from the center, etc., with the valve-body as the center.

For example, as illustrated in FIG. 5, there is a part of the pressure-alternating chamber 201 between the first end 1001 of the fluid splitter 1 and the valve casing 2, which is beneficial to the communication between the second opening 21*b* and the pressure-alternating chamber 201, is beneficial for the fluid splitter 1 to bear the alternating load, and is beneficial to the arrangement of the valve assembly (the first valve assembly described later) in the pressure-alternating chamber 201.

For example, as illustrated in FIGS. 5-6, the fluid end 3 further includes a first valve assembly 31 and a first guide portion 41. The first valve assembly 31 is located in the pressure-alternating chamber 201, and the first valve assembly 31 is configured to communicate the low-pressure chamber 202 with the pressure-alternating chamber 201 upon being opened or configured to separate the low-pressure chamber 202 from the pressure-alternating chamber 201 upon being closed; and the first assembly includes a first valve-body 31*a*, a first seal 31*b*, and a first valve seat 31*c*. As illustrated in FIG. 10, the first valve seat 31*c* is annular and includes a first intermediate bore 310, and the first intermediate bore 310 is configured to allow fluid to flow therethrough. As illustrated in FIGS. 11A-11C, the first valve-body 31*a* includes a first main portion 313, and a first guide rod 311 and a second guide rod 312 which are arranged at two sides of the first main portion 313, respectively; and a part of the first seal 31*b* is embedded in a first groove G1 of the first main portion 313. As illustrated in FIGS. 5 and 6, the first valve seat 31*c* and the first guide portion 41 are located in the first cavity 11*c*, and the first valve-body 31*a* is not in contact with the valve casing 2. For example, the first valve seat 31*c* is an annular circle, but is not limited thereto. The first valve assembly 31 adopts the cooperation of the first valve-body 31*a* and the first seal 31*b*, which is beneficial to improving the sealing effect and avoiding the leakage of the pressure.

In the fluid end provided by some embodiments of the present disclosure, the first valve-body 31*a* is not in contact with the valve casing 2, which can prevent the first valve-body 31*a* from wearing the valve casing 2 under the action of gravity. As illustrated in FIGS. 5-6, a gap is provided between the first valve-body 31*a* and the valve casing 2.

For example, as illustrated in FIGS. 5-6, the fluid end 3 further includes a first spring 51 and a spring seat 61. Referring to FIG. 5, FIG. 6 and FIG. 11A, the first spring 51 is located between the spring seat 61 and the first main portion 313. Referring to FIG. 5, FIG. 6, FIG. 9A and FIG. 9B, the first guide portion 41 includes a first guide seat 411 and a first guide sleeve 412 connected with the first guide seat 411, a first guide auxiliary member 401 can be provided in the first guide sleeve 412, the first guide seat 411 includes a first through hole 411*a*, and the first through hole 411*a* is configured to allow fluid to flow therethrough. As illustrated in FIG. 5, FIG. 6, FIG. 9A, FIG. 9B, and FIGS. 11A-11C, the first guide sleeve 412 is configured to receive a part of the first guide rod 311 so as to guide the first valve-body 31*a*. As illustrated in FIG. 5, FIG. 6, and FIG. 12, the spring seat 61 has a second guide sleeve 612, and the second guide sleeve 612 is configured to receive a part of the second guide rod 312 so as to guide the first valve-body 31*a*. Therefore, a double-side guide is formed to better guide the first valve-body 31*a* and make the structure of the fluid end more stable. The second guide sleeve 612 guides the opening and closing of the first valve-body 31. As illustrated in FIG. 5 and FIG. 6, a second guide auxiliary member 602 can be provided in the second guide sleeve 612 to prevent the second guide rod 312 from wearing the second guide sleeve 612.

As illustrated in FIG. 9A and FIG. 9B, the first guide seat 411 is connected with the first guide sleeve 412 through a first connection member 451 and a second connection member 452, and the first guide portion 41 includes two first through holes 411*a*. The first connection member 451 and the second connection member 452 are arranged at both sides of the first guide sleeve 412, respectively; and the two first through holes 411*a* are symmetrically arranged. It should be noted that the structure of the first guide portion 41 is not limited to that illustrated in FIG. 9A and FIG. 9B.

For example, as illustrated in FIG. 11B and FIG. 11C, the first seal 31*b* and the first valve-body 31*a* are integrated by interference fit to play a role of sealing. A first spring 51 is installed at one side of the first valve-body 31*a* to exert a spring force on the first valve-body 31*a*, and the first guide rod 311 and the second guide rod 312 at both sides of the first valve-body 31*a* are inserted into the first guide sleeve 412 and the second guide sleeve 612, respectively, so that the first valve-body 31*a* is not eccentric when the first valve-body 31*a* reciprocates left and right.

For example, as illustrated in FIG. 5 and FIG. 6, the spring seat 61 is provided in the inner chamber of the valve casing 2. For example, as illustrated in FIG. 12, the spring seat 61 has an annular groove 61G configured to place the first spring 51 and a hollowed structure 610 configured to allow fluid to flow therethrough. A spring force is always applied to the first valve-body 31 by the first spring 51. The spring seat 61 has a hollowed structure, which is convenient for the medium to flow therethrough. For example, the hollowed structure 610 is a through hole. FIG. 12 illustrates a plurality of hollowed structures 610. The hollowed structures 610 can be through holes. The plurality of hollowed structures 610 can be uniformly distributed. FIG. 12 illustrates three hollowed structures 610.

For example, as illustrated in FIG. 5 and FIG. 6, the fluid end 3 further includes a second valve assembly 32 and a second guide portion 42, the second valve assembly 32 is located in the high-pressure chamber 203, the second valve assembly 32 is configured to communicate the pressure-alternating chamber 201 with the high-pressure chamber 203 upon being opened or configured to separate the pressure-alternating chamber 201 from the high-pressure chamber 203 upon being closed; and the second valve assembly 32 includes a second valve-body 32*a*, a second seal 32*b*, and a second valve seat 32*c*. As illustrated in FIG. 5, FIG. 6, and FIG. 14, the second valve seat 32*c* is annular and includes a second intermediate bore 320, and the second intermediate bore 320 is configured to allow fluid to flow therethrough. As illustrated in FIG. 5, FIG. 6, and FIGS. 15A-15C, the second valve-body 32*a* includes a second main portion 325, and a third guide rod 323 and a fourth guide rod 324 which are arranged at two sides of the second main portion 325, respectively; and a part of the second seal 32*b* is embedded in a second groove G2 of the second main portion 325. As illustrated in FIG. 5 and FIG. 6, the fluid end 3 further includes a second spring 52 and a cover 62, the second spring 52 is located between the cover 62 and the second main portion 325, and the second guide portion 42 includes a second guide seat 421 and a third guide sleeve 422. As illustrated in FIG. 5, FIG. 6, FIG. 13A, and FIG. 13B, the second guide seat 421 includes a second through hole 421*a*, the second through hole 421*a* is configured to allow fluid to flow therethrough, and the third guide sleeve 422 is configured to receive a part of the third guide rod 323 so as to guide the second valve-body 32*a*. Therefore, a double-side guide is formed to better guide the second valve-body 32*a* and make the structure of the fluid end more stable. As illustrated in FIG. 5, FIG. 6, FIG. 13A, and FIG. 13B, a third guide auxiliary member 403 can be provided in the third guide sleeve 422 to prevent the third guide rod 323 from wearing the third guide sleeve 422. As illustrated in FIG. 5, FIG. 6, and FIG. 16, the cover 62 has a fourth guide sleeve 624, and the fourth guide sleeve 624 is configured to receive a part of the fourth guide rod 324 so as to guide the second valve-body 32*a*.

As illustrated in FIG. 13A and FIG. 13B, in order to facilitate the passage of fluid, the second guide seat 421 is connected with the third guide sleeve 422 through a third connection member 453 and a fourth connection member 454, and the second guide portion 42 includes two second through holes 421*a*. The third connection member 453 and the fourth connection member 454 are arranged at both sides of the third guide sleeve 422, respectively; and the two second through holes 421*a* are symmetrically arranged. It should be noted that the structure of the second guide portion 42 is not limited to that illustrated in FIG. 13A and FIG. 13B.

Referring to FIG. 2A, FIG. 2B, FIG. 5, and FIG. 6, the first step surface 11*s* can be configured to place the first guide portion 41, and the second step surface 21*s* can be configured to place the second guide portion 42. That is, the first step surface 11*s* is configured to limit a position of the first guide portion 41, and the second step surface 21*s* is configured to limit a position of the second guide portion 42.

For example, the second seal 32*b* and the second valve-body 32*a* are integrated by interference fit to play a role of sealing. A second spring 52 is installed at one side of the second valve-body 32*a* to exert a spring force on the second valve-body 32*a*, and the third guide rod 323 and the fourth guide rod 324 at both sides of the second valve-body 32*a* are inserted into the third guide sleeve 422 and the fourth guide sleeve 624, respectively, so that the second valve-body 32*a* is not eccentric when the second valve-body 32*a* reciprocates left and right.

For example, the first valve assembly 31 and the second valve assembly 32 are symmetrically distributed and interchangeable, and the first spring 51 and the second spring 52 are also interchangeable.

For example, as illustrated in FIG. 16, the fourth guide sleeve 624 is provided with a drain hole 6240, and the drain hole 6240 is configured to allow fluid to flow therethrough. As illustrated in FIG. 5 and FIG. 6, in the case where a fourth guide auxiliary member 604 is provided in the fourth guide sleeve 624, the fourth guide auxiliary member 604 can also be provided with a drain hole, so that fluid can also flow out through the drain hole in the fourth guide auxiliary member 604 as well as the drain hole in the fourth guiding sleeve 624.

For example, as illustrated in FIG. 5, FIG. 6, and FIG. 16, the cover 62 has a cage structure. As illustrated in FIG. 5 and FIG. 6, the cover 62 has four functions as follows: 1) facilitate the smooth entry of high-pressure fluid into the outlet bore; 2) hold the fluid splitter to prevent the fluid splitter from moving back and forth; 3) act as a spring seat of the second valve-body; 4) act as a guide seat for the second valve-body. The cover 62 is manufactured with a drain hole, which is beneficial to the movement of the second valve-body, and therefore, the fluid can flow out when the fourth guide rod of the second valve-body moves, so that the second valve-body moves smoothly. For example, the cover is sealed and isolated by a sealing ring to prevent fluid from entering the cover and to prevent the thread from rusting. For example, the cover is provided with a pulling hole, which is convenient for disassembly during maintenance. The cover has multiple functions combined in itself, which makes the fluid end structure compact.

As illustrated in FIG. 17, the positions limiting of the first valve seat 31*c* and the fluid splitter 1 are achieved by cooperation of a cone matching with a tapered hole, so as to avoid the first valve seat 31*c* from shifting during discharging the fluid. The reference numeral 1*a* in FIG. 17 refers to a surface of the tapered hole. FIG. 17 also illustrates a position-limiting structure 1*b*, the position-limiting structure 1*b* includes a position-limiting step to limit the position of the first guide portion 41. The arrangement of the tapered hole realizes that the first valve seat 31*c* is closely attached to the fluid splitter 1 and presses the first guide seat 411 during a fluid discharge process. The first guide seat 411 can support the first valve seat 31*c* and prevent it from moving to the right. As illustrated in FIG. 17, an angle formed between a surface of the first valve seat 31*c* abutting against the fluid splitter 1 and a surface of the first valve seat 31*c* abutting against the first guide seat 411 is obtuse to fit the surface of the tapered hole.

For example, in the embodiment of the present disclosure, the guide auxiliary member plays a role of guiding and wear-avoiding. The guide auxiliary member can adopt a rubber material, but it is not limited thereto. The guide auxiliary member include at least one of the first guide auxiliary member 401, the second guide auxiliary member 602, the third guide auxiliary member 403, and the fourth guide auxiliary member 604.

In the fluid end provided by the embodiment of the present disclosure, in order to facilitate installation and maintenance, the first valve assembly 31 and the second valve assembly 32 can be used interchangeably.

In the fluid end provided by the embodiment of the present disclosure, the inner chamber can be single cylinder or multiple cylinders.

The fluid end provided by the embodiment of the present disclosure can be used with a plunger pump, a linear motor, and other apparatus. In the case where used with the linear motor, the fluid end is symmetrically distributed at both sides of the motor.

For example, as illustrated in FIG. 5 and FIG. 6, the fluid end 3 further includes a nut 63, the nut 63 is screwed with the valve casing 2, and the nut 63 is configured to press the cover 62.

For example, as illustrated in FIG. 5 and FIG. 6, the fluid end 3 further includes a plunger 8 and a clamp 7, and the interior motion components of the fluid end 3 are the plunger 8, the first valve-body 31*a*, and the second valve-body 32*a*, all of which moves in a reciprocating way.

For example, one side of the clamp 7 of the fluid end is installed on the plunger, the other side of the clamp 7 can be linked with the plunger pump or a linear motor, and other components/parts are installed in the valve casing.

For example, as illustrated in FIG. 5 and FIG. 6, a clamp 7 is installed at one side of the plunger 8 to facilitate the linkage between the plunger 8 and a plunger pump or a linear motor, the other side of the plunger 8 extends into the valve casing 2, and the other side of the plunger 8 is provided with a pulling hole to facilitate pulling out of the plunger from the right side of the valve casing during later maintenance; there is a non-interference fit between the plunger and the valve casing, so it needs to be sealed and leak-proof. Here, the sealing element is a packing assembly 27 which includes an oil scraper ring and a packing member. The packing member is installed between a spacer ring and a pressing ring, and the oil scraper ring is installed at an inner side of a packing nut 28; the packing nut 28 is screwed with the valve casing 2, the packing nut is tightened to squeeze and expand the packing member to play a role of sealing; the right end of the packing nut 28 is manufactured with a small through hole, which is convenient for grease in the grease injection bore to enter the valve casing 2, so as to lubricate the packing member and the plunger; the left end of the packing nut is manufactured with a large blind hole, which is convenient for tightening the packing nut with tools.

The operation principle of the fluid end provided by the embodiment of the present disclosure is as follows.

When the plunger 8 moves backward (the plunger moves to the left in FIG. 5 and FIG. 6, and FIG. 5 illustrates the starting position of the plunger moving to the left), the interior volume of the valve casing 2 gradually increases to form a local vacuum; and at this time, the first valve assembly 31 is opened, the second valve assembly 32 is closed, and the medium enters the inner chamber 200 of the valve casing 2 through the inlet hole 211 and the first channel 11*b* in the fluid splitter 1; when the plunger 8 moves back to an extreme position, the inner chamber 200 of the valve casing 2 is filled with the medium, and the fluid suction action is completed.

When the plunger 8 moves forward (the plunger moves to the right in FIG. 5 and FIG. 6, and FIG. 6 illustrates the ending position of the plunger moving to the right), the interior volume of the valve casing 2 gradually decreases, the medium is squeezed, and the pressure increases; and at this time, the second valve assembly 32 is opened, the first valve assembly 31 is closed, the medium enters the outlet bore 212 through the second channel 21*b* in the fluid splitter 1 under the action of the pressure; when the plunger moves forward to an extreme position, the interior volume of the valve casing 2 is minimum, and the fluid discharge action ends. As the plunger 8 reciprocates continuously, the processes of fluid suction and fluid discharge are alternately carried out, and the high-pressure medium is continuously output.

The medium mentioned above is a fluid, which can also be called a substance which is split.

Figure 18:
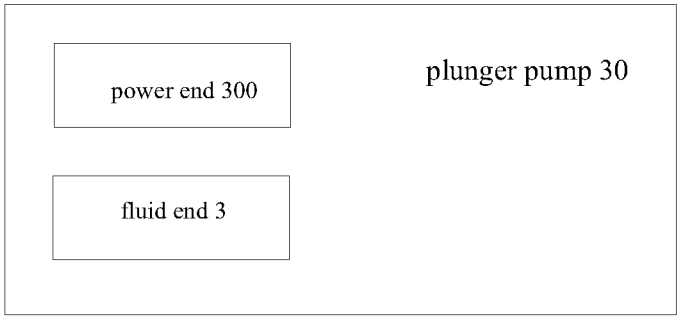
FIG. 18 is a schematic diagram of a plunger pump provided by at least one embodiment of the present disclosure.

At least one embodiment of the present disclosure further provides a plunger pump 30, as illustrated in FIG. 18, which includes any one of the fluid ends 3 described above. The plunger pump 30 further includes a power end 300. The structure of the power end 300 can be referred to the power end 002 illustrated in FIG. 1.

For example, the plunger pump can be an electric drive plunger pump, a vehicle-mounted plunger pump, and a plunger pump driven by a linear motor.

What have been described above are only specific implementations of the present disclosure, the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be based on the protection scope of the claims.

What is claimed is:

1. A fluid splitter, comprising:

a body, wherein the body has a shape of column, and the body comprises a first end, a second end, and a side surface connecting the first end and the second end;

a first opening, located at the side surface of the body;

a first cavity, located at the first end;

a first channel, communicated with the first opening and the first cavity, respectively, wherein the first channel extends from the first opening to the first cavity and is configured to allow fluid to flow therethrough;

a second opening, located at the side surface of the body;

a second cavity, located at the second end; and a second channel, communicated with the second opening and the second cavity, respectively, wherein the second channel extends from the second opening to the second cavity and is configured to allow fluid to flow therethrough, wherein the first opening is closer to the second end than the second opening, and the second opening is closer to the first end than the first opening.

2. The fluid splitter according to claim 1, wherein the first opening and the second opening are located at different positions in an axial direction of the body.

3. The fluid splitter according to claim 1, wherein the first opening and the second opening face towards different directions and have a same size.

4. The fluid splitter according to claim 1, wherein the first channel is not communicated with the second channel, and the first cavity is not communicated with the second cavity.

5. The fluid splitter according to claim 1, wherein the body comprises a first flow guide portion, a plurality of first channels are provided, the plurality of first channels are separated by the first flow guide portion, and the plurality of first channels are converged at the first cavity.

6. The fluid splitter according to claim 5, wherein a plurality of first openings are provided, the plurality of first channels are in one-to-one correspondence with the plurality of first openings, the plurality of first openings are distributed along a circumferential direction of the body, and the plurality of first openings are located at a same position in an axial direction of the body.

7. The fluid splitter according to claim 1, wherein the body comprises a second flow guide portion, a plurality of second channels are provided, the plurality of second channels are separated by the second flow guide portion, and the plurality of second channels are converged at the second cavity.

8. The fluid splitter according to claim 7, wherein a plurality of second openings are provided, the plurality of second channels are in one-to-one correspondence with the plurality of second openings, the plurality of second openings are distributed along a circumferential direction of the body, and the plurality of second openings are located at a same position in an axial direction of the body.

9. The fluid splitter according to claim 1, wherein the first cavity comprises a first step surface, and the first step surface divides the first cavity into two first sub-cavities having different areas in radial section; the second cavity comprises a second step surface, and the second step surface divides the second cavity into two second sub-cavities having different areas in radial section.

10. A fluid end, comprising:

a valve casing, comprising an inner chamber; and a fluid splitter, located in the inner chamber, wherein the fluid splitter comprises:

a body, wherein the body has a shape of column, and the body comprises a first end, a second end, and a side surface connecting the first end and the second end;

a first opening, located at the side surface of the body;

a first cavity, located at the first end;

a first channel, communicated with the first opening and the first cavity, respectively, wherein the first channel extends from the first opening to the first cavity and is configured to allow fluid to flow therethrough;

a second opening, located at the side surface of the body;

a second cavity, located at the second end; and a second channel, communicated with the second opening and the second cavity, respectively, wherein the second channel extends from the second opening to the second cavity and is configured to allow fluid to flow therethrough, wherein the first opening is closer to the second end than the second opening, and the second opening is closer to the first end than the first opening.

11. The fluid end according to claim 10, wherein the inner chamber comprises a pressure-alternating chamber, a low-pressure chamber, and a high-pressure chamber; the pressure-alternating chamber, the low-pressure chamber, and the high-pressure chamber are sequentially arranged in an axial direction of the valve casing, the second end is located in the high-pressure chamber, the first opening is located in the low-pressure chamber, the first end and the second opening are located in the pressure-alternating chamber, the second opening is communicated with the pressure-alternating chamber, the valve casing comprises an inlet bore and an outlet bore, the inlet bore is communicated with the first opening, and the outlet bore is communicated with the high-pressure chamber.

12. The fluid end according to claim 11, further comprising a plunger, wherein the inner chamber further comprises a plunger chamber, the plunger chamber is configured to receive the plunger, and the plunger chamber, the pressure-alternating chamber, the low-pressure chamber, and the high-pressure chamber are sequentially arranged in the axial direction of the valve casing.

13. The fluid end according to claim 11, wherein a part of the pressure-alternating chamber is arranged between the first end of the fluid splitter and the valve casing.

14. The fluid end according to claim 11, further comprising a first valve assembly and a first guide portion, wherein the first valve assembly is located in the pressure-alternating chamber, and the first valve assembly is configured to communicate the low-pressure chamber with the pressure-alternating chamber upon being opened, or configured to separate the low-pressure chamber from the pressure-alternating chamber upon being closed, the first valve assembly comprises a first valve-body, a first seal, and a first valve seat; the first valve seat is annular and comprises a first intermediate bore, the first intermediate bore is configured to allow fluid to flow therethrough, the first valve-body comprises a first main portion, and a first guide rod and a second guide rod which are arranged at two sides of the first main portion, respectively; a part of the first seal is embedded in a first groove of the first main portion, the first valve seat and the first guide portion are located in the first cavity, and the first valve-body is not in contact with the valve casing.

15. The fluid end according to claim 14, further comprising a first spring and a spring seat, wherein the first spring is located between the spring seat and the first main portion, the first guide portion comprises a first guide seat and a first guide sleeve connected with the first guide seat, the first guide seat comprises a first through hole, the first through hole is configured to allow fluid to flow therethrough, the first guide sleeve is configured to receive a part of the first guide rod so as to guide the first valve-body, the spring seat has a second guide sleeve, and the second guide sleeve is configured to receive a part of the second guide rod so as to guide the first valve-body.

16. The fluid end according to claim 15, wherein the spring seat has an annular groove configured to place the first spring and a hollowed structure configured to allow fluid to flow therethrough.

17. The fluid end according to claim 11, further comprising a second valve assembly and a second guide portion, wherein the second valve assembly is located in the high-pressure chamber, and the second valve assembly is configured to communicate the pressure-alternating chamber with the high-pressure chamber upon being opened or configured to separate the pressure-alternating chamber from the high-pressure chamber upon being closed, the second valve assembly comprises a second valve-body, a second seal, and a second valve seat; the second valve seat is annular and comprises a second intermediate hole, the second intermediate hole is configured to allow fluid to flow therethrough, the second valve-body comprises a second main portion, and a third guide rod and a fourth guide rod which are arranged at two sides of the second main portion, respectively; a part of the second seal is embedded in a second groove of the second main portion, the fluid end further comprises a second spring and a cover, the second spring is located between the cover and the second main portion, the second guide portion comprises a second guide seat and a third guide sleeve connected with the second guide seat, the second guide seat comprises a second through hole, the second through hole is configured to allow fluid to flow therethrough, the third guide sleeve is configured to receive a part of the third guide rod so as to guide the second valve-body, the cover has a fourth guide sleeve, and the fourth guide sleeve is configured to receive a part of the fourth guide rod so as to guide the second valve-body.

18. The fluid end according to claim 17, wherein the second guide sleeve is provided with a drain hole, and the drain hole is configured to allow fluid to flow therethrough.

19. A plunger pump, comprising a fluid end, the fluid end comprising:

a valve casing, comprising an inner chamber; and a fluid splitter, located in the inner chamber, wherein the fluid splitter comprises:

a body, wherein the body has a shape of column, and the body comprises a first end, a second end, and a side surface connecting the first end and the second end;

a first opening, located at the side surface of the body;

a first cavity, located at the first end;

a first channel, communicated with the first opening and the first cavity, respectively, wherein the first channel extends from the first opening to the first cavity and is configured to allow fluid to flow therethrough;

a second opening, located at the side surface of the body;

a second cavity, located at the second end; and a second channel, communicated with the second opening and the second cavity, respectively, wherein the second channel extends from the second opening to the second cavity and is configured to allow fluid to flow therethrough, wherein the first opening is closer to the second end than the second opening, and the second opening is closer to the first end than the first opening.

* * * * *